US008327786B2

(12) United States Patent
Morris

(10) Patent No.: US 8,327,786 B2
(45) Date of Patent: Dec. 11, 2012

(54) HATCH COVER AND ASSOCIATED PERSONAL WATERCRAFT SYSTEM

(76) Inventor: Keith Morris, Grand Marais, MN (US)

( * ) Notice: Subject to any disclaimer, the term of this patent is extended or adjusted under 35 U.S.C. 154(b) by 426 days.

(21) Appl. No.: 12/702,081

(22) Filed: Feb. 8, 2010

(65) Prior Publication Data

US 2011/0192335 A1 Aug. 11, 2011

(51) Int. Cl.
*B63B 19/12* (2006.01)

(52) U.S. Cl. ..... 114/203; 114/347; 114/361

(58) Field of Classification Search ..... 114/203, 114/347, 361

See application file for complete search history.

(56) References Cited

U.S. PATENT DOCUMENTS 6,073,574 A 6/2000 King et al.
6,289,834 B1 * 9/2001 Phillips ..... 114/211
6,401,648 B1 6/2002 Abbenhouse
7,032,531 B1 4/2006 Caples
7,121,225 B1 10/2006 Caples
7,562,635 B1 7/2009 Morris
2005/0204993 A1 * 9/2005 Lang ..... 114/347
2009/0095854 A1 * 4/2009 Forbes et al. ..... 248/176.3
2009/0174225 A1 * 7/2009 Day ..... 296/193.08

OTHER PUBLICATIONS

TopKayaker.Net's Guide to Kayak Hatch Repair & Maintenance, www.topkayaker.net/Articles/Instruction/LargeHatches.html, publicly available at least as early as Jun. 13, 2008 per the Internet Archive available at www.internetarchive.org, 5 pages.

* cited by examiner

*Primary Examiner* — Stephen Avila
(74) *Attorney, Agent, or Firm* — Griffiths & Seaton PLLC

(57) ABSTRACT

A personal watercraft system includes a watercraft, a frame, and a cover. The watercraft includes a deck and a hull and defines a hatch providing access to a cargo hold. The frame is coupled with the watercraft and defines a channel on a side of the hatch and a cavity in communication with the channel. The cover includes a fabric portion and a rod extending along and coupled with a side margin thereof. The cover is secured to the personal watercraft on an opposite side of the hatch. When compression is applied to the rod, the rod flexes to fit within the channel aligning an end of the rod with the cavity. When the compression is subsequently removed from the rod, the rod returns to its original length and the end of the rod slides into the cavity securing the cover to entirely cover the hatch.

19 Claims, 12 Drawing Sheets

HATCH COVER AND ASSOCIATED PERSONAL WATERCRAFT SYSTEM

BACKGROUND OF THE INVENTION

Modern day kayaks are used for sport and/or recreation. Commonly, such vessels are designed primarily for relatively short term use on a single body of water and are not well suited for frequent or lengthy portaging between bodies of water or other loading and unloading of large or multiple objects. As a result, kayak storage hatches are generally quite small with small openings providing access to the corresponding hatches. To prevent or decrease the ingress of unwanted water and other elements into the hatch and the dry goods or other items stored therein, hatch covers are secured over the hatch openings.

Conventional hatch covers are often small in size and difficult to secure and/or store during periods of non-use. To provide a water tight seal, multiple piece hatch covers are commonly utilized, for example, a tight neoprene or similar elasticized cover is stretched over the hatch cover followed by placement of a hard, rigid, plastic cover over the neoprene cover and strapped to the kayak using various connecting devices. The rigid covers add considerable weight to the kayak and rigidly extend over the corresponding hatches such that no item may extend above a top edge of the hatch.

SUMMARY OF THE INVENTION

One aspect of the present invention relates to a personal watercraft system including a personal watercraft, a frame, and a cover. The personal watercraft includes a deck and a hull and defines a hatch through the deck providing access to a cargo hold inside the personal watercraft. The frame is coupled with the personal watercraft and defines an elongated channel on a first side of the hatch and a cavity extending away from, substantially axially aligned with, and in communication with the elongated channel. The cover includes a flexible fabric portion and a rod extending along and coupled with a side margin of the flexible fabric portion. The cover is configured to be secured to the personal watercraft on a second side of the hatch opposite the first side of the hatch. When a compressive force is applied to the rod, the rod flexes to fit within the elongated channel such that an end of the rod is aligned with the cavity. When the compressive force is subsequently removed from the rod, the rod returns to its original length and the end of the rod slides into the cavity in a manner securing the cover to the personal watercraft to entirely cover the hatch. Other hatch covers, systems, and method are also disclosed.

BRIEF DESCRIPTION OF THE DRAWINGS

Embodiments of the invention will be described with respect to the figures, in which like reference numerals denote like elements, and in which.

DETAILED DESCRIPTION

The following detailed description of the invention is merely exemplary in nature and is not intended to limit the invention or the application and uses of the invention. Furthermore, there is no intention to be bound by any theory presented in the preceding background of the invention or the following detailed description of the invention.

A kayak or other personal watercraft, according to embodiments of the invention, defines at least one hatch and a hatch cover. A frame is formed around and spaced outwardly from a hatch opening and is configured to receive the hatch cover. In one embodiment, the hatch cover is formed of a flexible fabric with rods longitudinally extending along the length of opposing sides of the fabric. The rods are deflected and placed within opposing reception channels defined by the frame to securely hold the hatch cover in place in a substantially water-resistant manner while still allowing the hatch cover to be removed easily when desired.

Figure 1:
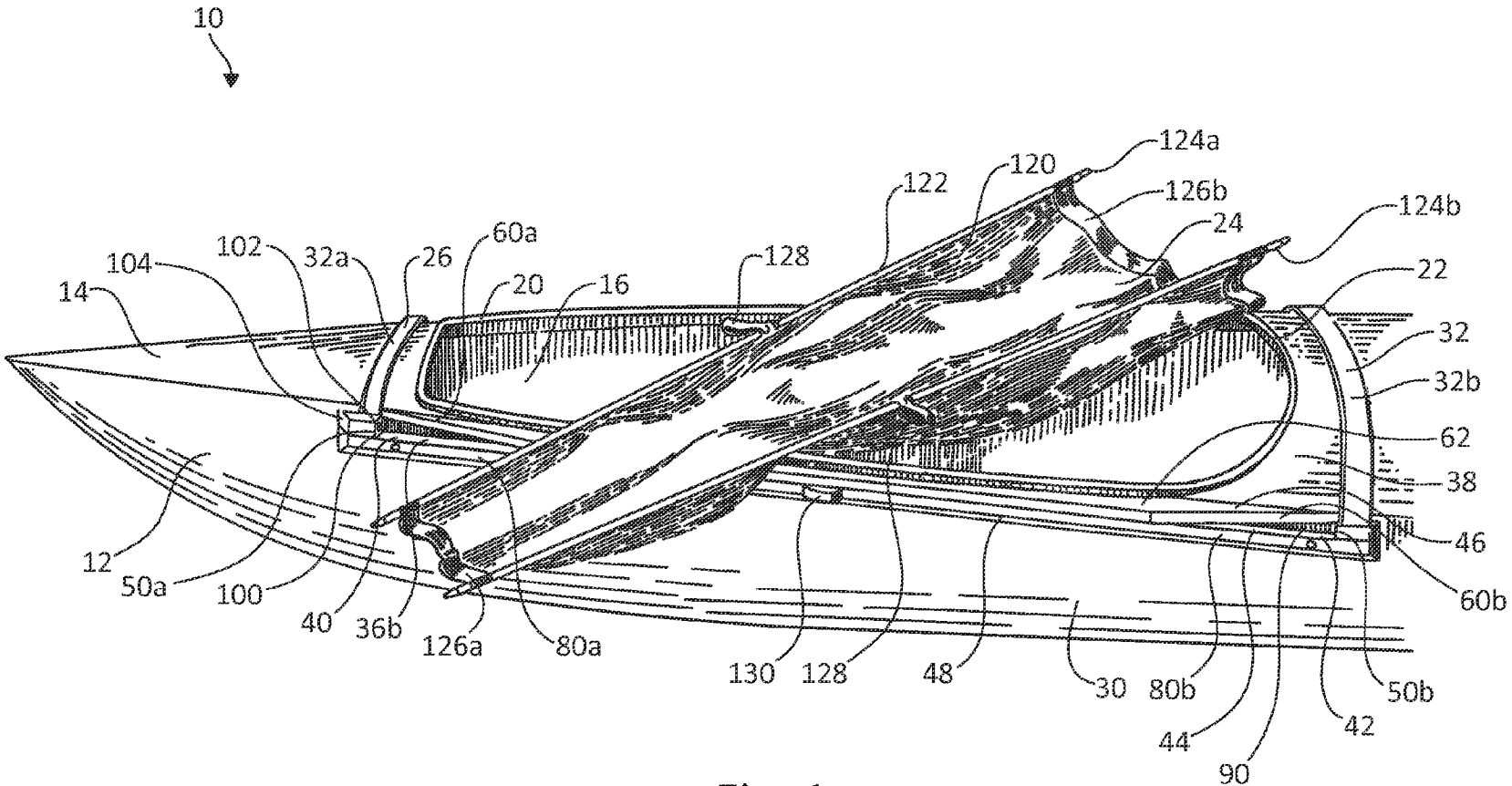
FIG. 1 is a perspective view illustration of a kayak including a hatch and a hatch cover, according to one embodiment of the present invention.
Figure 2:
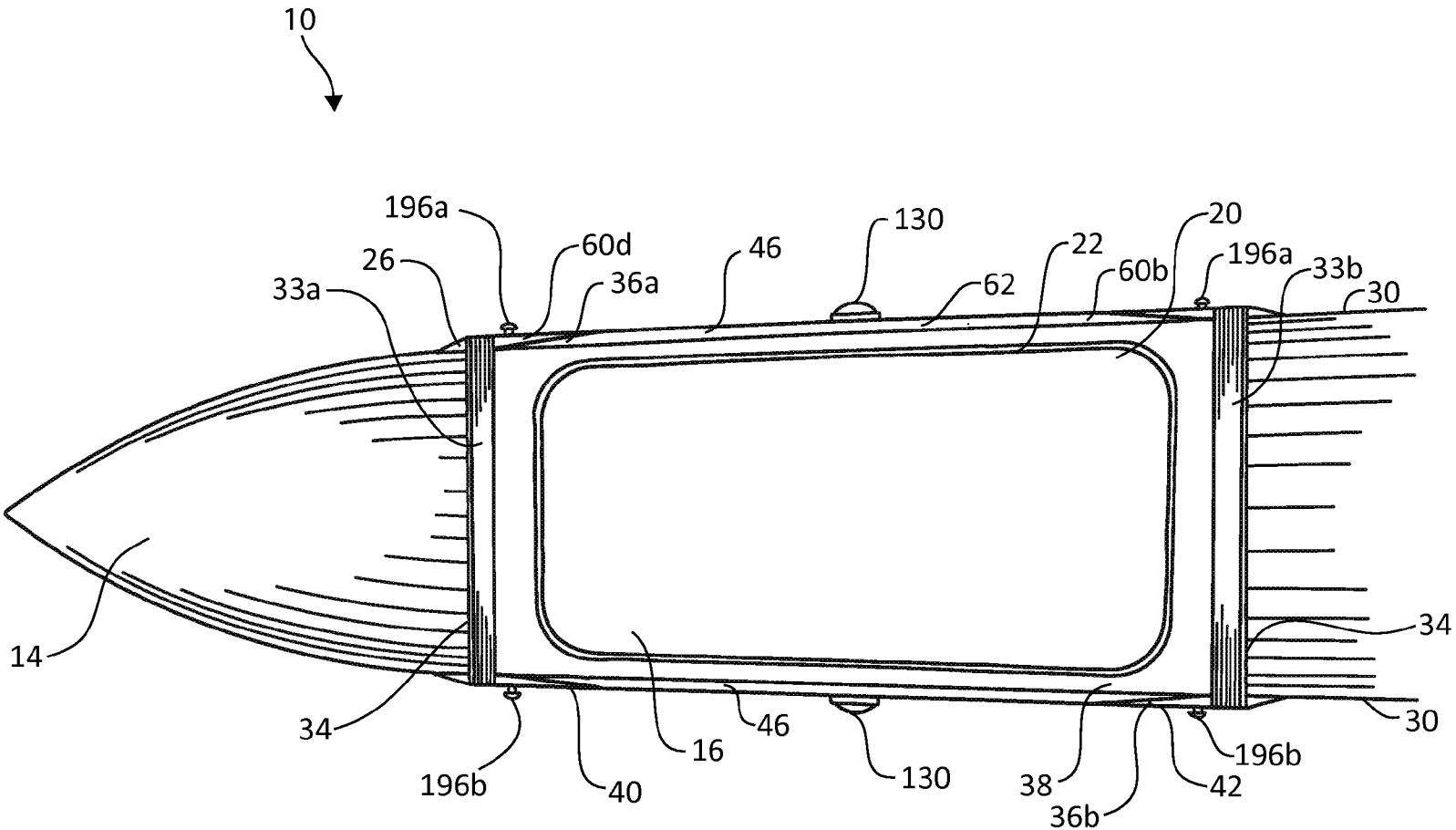
FIG. 2 is a top view illustration of a portion of the kayak of FIG. 1, according to one embodiment of the present invention.

Turning to the figures, FIG. 1 illustrates a kayak 10 or other suitable watercraft, according to one embodiment of the present invention. Kayak 10 includes a hull 12 and a deck 14 and may be formed of wood, plastic, fiberglass, other suitable material, or combination thereof. A storage area or cargo hold 16 is formed within kayak 10 between hull 12 and deck 14 and is accessible via an opening or hatch 20 extending through deck 14. In one example, one hatch 20 is formed in front of and/or one hatch 20 is formed behind a cockpit 18 (FIG. 14) open through deck 14. A hatch cover 24 is provided to extend entirely over hatch 20 in a manner protecting contents therein from environmental elements, such as wind, water, snow, and/or mud. While hatch cover 24 is suitable for use with hatches 20 of standard size, in one example, hatch cover 24 is particularly advantageous for hatches 20 of a larger than standard size (e.g., with an outer diameter or dimension greater than about one foot, and, in one embodiment, with an outer diameter or dimension greater than about two feet). The larger hatches 20 may be used with kayaks configured to store larger items or more items, for example, during extended length excursions and/or multiple or lengthy portages. Larger hatches 20 also facilitate relatively easy and repeated removal of items from cargo hold 16, which is common during an excursion including multiple portages.

Hatch cover 24, according to embodiments of the present invention, is substantially formed of a lightweight, flexible, water-resistant material and is configured to be easily removed and stored when not in use and easily snapped into place covering hatch 20 during use. In one embodiment, to facilitate secure attachment of hatch cover 24 around hatch 20, a frame 26 is formed around hatch 20. Frame 26 extends entirely around hatch 20 or extends around only portions of hatch 20, for example, just outside of opposing sides of hatch cover 24. In one embodiment, hull 12 defines two opposing hull sidewalls 30 with deck 14 extending therebetween, and frame 26 includes deck hydraulic barriers 32 extending over deck 14 between opposing hull sidewalls 30. More specifically, deck hydraulic barriers 32 include a fore barrier 32*a* and an aft barrier 32*b*, one on either side of the respective hatch 20. Each of fore barrier 32*a* and aft barrier 32*b* is hydraulically sealed relative to deck 14, and in one example, each of fore barrier 32*a* and aft barrier 32*b* defines an angled surface 34 tapered toward deck 14 as each of fore barrier 32*a* and aft barrier 32*b* extends away from the corresponding hatch 20.

In one example, a rim or raised inner gasket 22 entirely and circumferentially surrounds and is positioned to extend coextensively with an outer perimeter of hatch 20 to form an elevated surface for interacting with a portion of hatch cover 24. An outer gasket 38 covers an entire area of deck 14 between fore barrier 32*a* and aft barrier 32*b* and around raised inner gasket 22 and/or extends at least partially beneath each of fore barrier 32*a* and aft barrier 32*b*. In one embodiment, outer gasket 38 is a thin material relative to raised inner gasket 22 and/or fore barrier 32*a* and aft barrier 32*b*, such as a thin, soft, water-resistant foam or other suitable material. When assembled, in one example, raised inner gasket 22 extends further away from deck 14 than outer gasket 38. In one example, deck hydraulic barriers 32 each extend from deck 14 further than outer gasket 38, and in one embodiment, further from deck than raised inner gasket 22.

In one embodiment, frame 26 additionally includes at least one rod receptacle or any other suitable receptacle, more particularly, for example, a starboard rod receptacle 36*a* and a port rod receptacle 36*b*. Each of starboard and port rod receptacles 36*a* and 36*b* extend along an opposite hull sidewall 30 near deck 14, and in one embodiment, deck hydraulic barriers 32 each extend from a respective end (e.g., aft or fore ends) of starboard rod receptacle 36*a* to port rod receptacle 36*b* or at least over portions of deck 14 extending therebetween. Each of starboard and port rod receptacles 36*a* and 36*b* are configured to securely receive a portion of hatch cover 24 in a water resistant matter such that very little if any water spray, etc. will generally penetrate hatch cover 24 to reach hatch 20 when hatch cover 24 is secured to frame 26.

In one embodiment, starboard rod receptacle 36*a* includes a fore end 40, an aft end 42 opposite fore end 40, an upper channel member 46, and a lower channel member 48 opposite upper channel member 46 to define an elongated channel 44 therebetween. In one example, each of upper channel member 46 and lower channel member 48 extends along a length of starboard rod receptacle 36*a* and are spaced from each other to snuggly receive a portion of hatch cover 24 as will be further described below. In one embodiment, lower channel member 48 extends substantially entirely along the length of starboard rod receptacle 36*a*, while upper channel member 46 is slightly shorter. In one example, fore and aft rod reception or rod reception pockets 50*a* and 50*b* are formed at opposite ends of elongated channel 44 closing the ends of elongated channel 44 such that only an outer face or outer open slot 92 provides external access to elongated channel 44.

In one embodiment, upper channel member 46 includes a fore end section 60*a* and an aft end section 60*b* opposite fore end section 60*a* and an elongated or intermediate section 62 extending therebetween. In one example, each of fore and aft end sections 60*a* and 60*b* tapers toward hull sidewall 30 as they extend away from intermediate section 62. Upper channel member 46 defines a rear surface 64, an opposing front surface 66, a bottom surface 68, and a top surface 70 opposite bottom surface 68. Rear surface 64 of upper channel member 46 is secured to hull sidewall 30 to extend downwardly from near a boundary between hull 12 and deck 14. Bottom surface 68 is positioned adjacent (e.g., directly adjacent) elongated channel 44, and in one embodiment, top surface 70 is positioned as a substantially smooth extension of deck 14 or is positioned slightly lower than deck 14.

Figure 6:
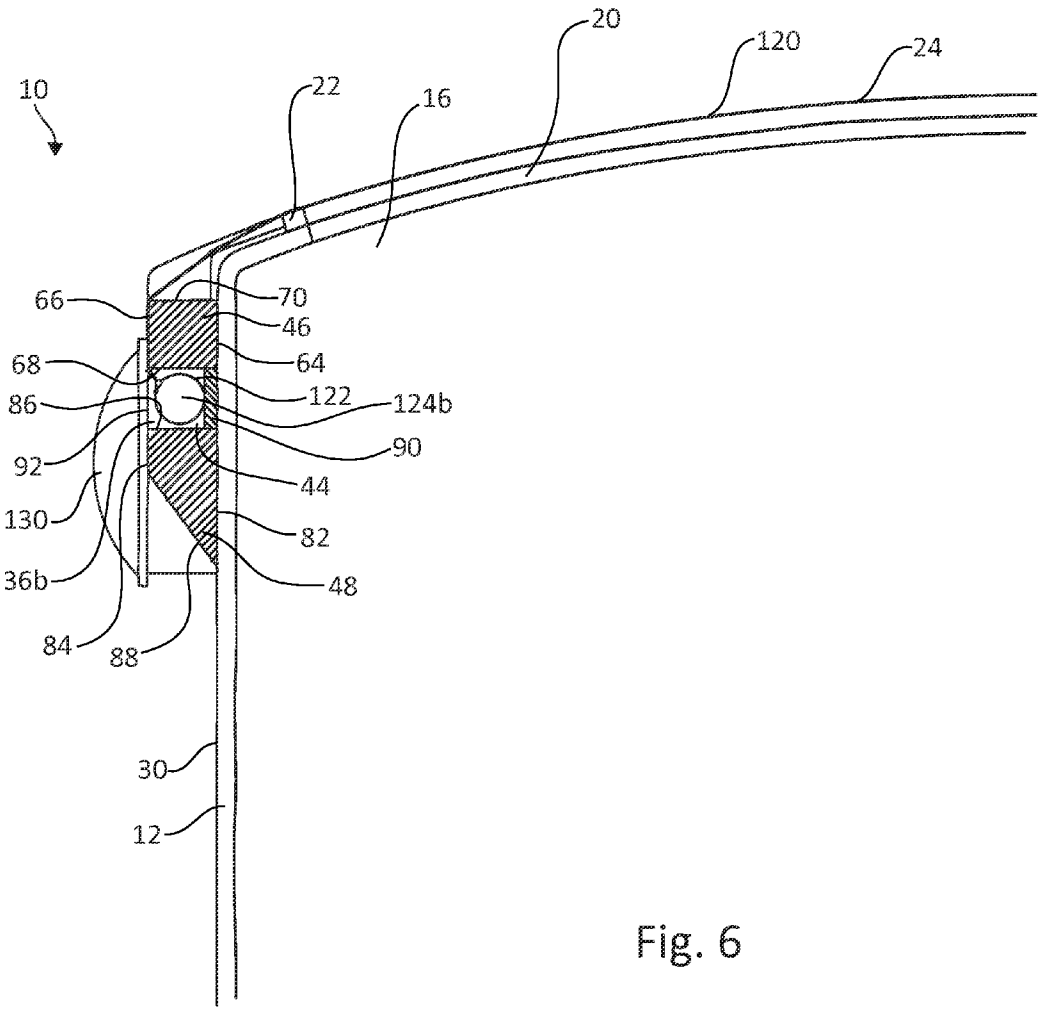
FIG. 6 is a cross-sectional illustration of the kayak taken about the line Y-Y as indicated in FIG. 2, according to one embodiment of the present invention.

In one example, lower channel member 48 includes a fore end section 80*a* and an aft end section 80*b* and extends with a substantially continuous cross-sectional shape and size between fore and aft end sections 80*a* and 80*b*. Lower channel member 48 defines a rear surface 82, an opposing front surface 84, a top surface 86, and a bottom surface 88 opposite top surface 86. Rear surface 82 of lower channel member 48 is secured to hull sidewall 30 below upper channel member 46 to define elongated channel 44 between bottom surface 68 of upper channel member 46 and top surface 86 of lower channel member 48. Bottom surface 68 extends from front surface 84 toward the corresponding hull sidewall 30, for example, in an angle or tapered manner as illustrated, for instance, in FIG. 6. The angled orientation of bottom surface 88 helps break the hydraulic pressure of water from waves, etc. by deflecting the force of the water away from hull 12 and hatch 20 and otherwise shedding water spray etc., which contributes to a dry storage of items within hatch 20.

In one embodiment a thin, rod channel gasket 90 is placed within elongated channel 44, for example, to extend along a substantial length of elongated channel 44 and is adhered or otherwise coupled to hull sidewall 30. Rod channel gasket 90 is formed of a relative thin, resilient and water resistant material. Outer open slot 92, which provided access to elongated channel 44, is defined opposite hull sidewall 30 (e.g., opposite rod channel gasket 90) and facilitates interaction with hatch cover 24.

In one embodiment, the length of elongated channel 44 is defined between fore and aft rod reception pockets 50*a* and 50*b*. Each of rod reception pockets 50*a* and 50*b* defines an internal end surface 100 facing elongated channel 44 and, in one example, each other. A cavity 102 extends from each internal end surface 100 away from elongated channel 44 (e.g., cavity 102 in fore rod reception pocket 50*a* extends forwardly, and cavity 102 in aft rod reception pocket 50*b* extends rearwardly). In one example, each cavity 102 has a depth between about ⅝ inch and about ¾ inch and a diameter or other outer dimension of between about 3/16 inch and about 7/16 inch (e.g., 5/16 inch). In one embodiment, one or both of end sections 80*a* and 80*b* of lower channel member 48 and one or both of fore and aft rod reception pockets 50*a* and/or 50*b* are angled inward toward hull side wall 30 at external ends thereof to once again break hydraulic pressure and provide for additional protection from water spray, etc. during use of kayak 10. It should be understood that while only starboard rod receptacle 36*a* is described in detail above that port rod receptacle 36*b* is similarly formed on an opposite side of hull 12.

Figure 7:
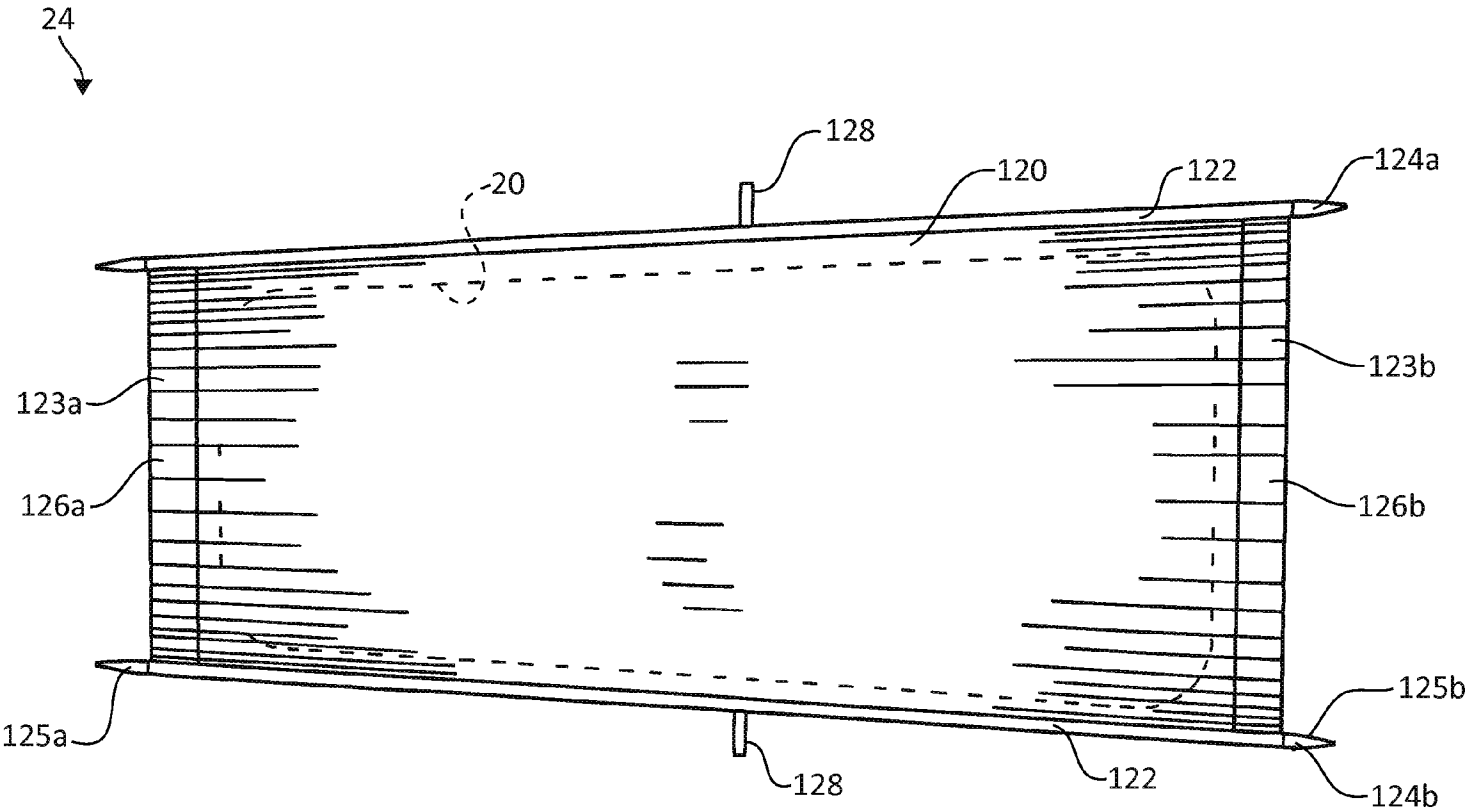
FIG. 7 is a top view illustration of the hatch cover of FIG. 1, according to one embodiment of the present invention.
Figure 8:
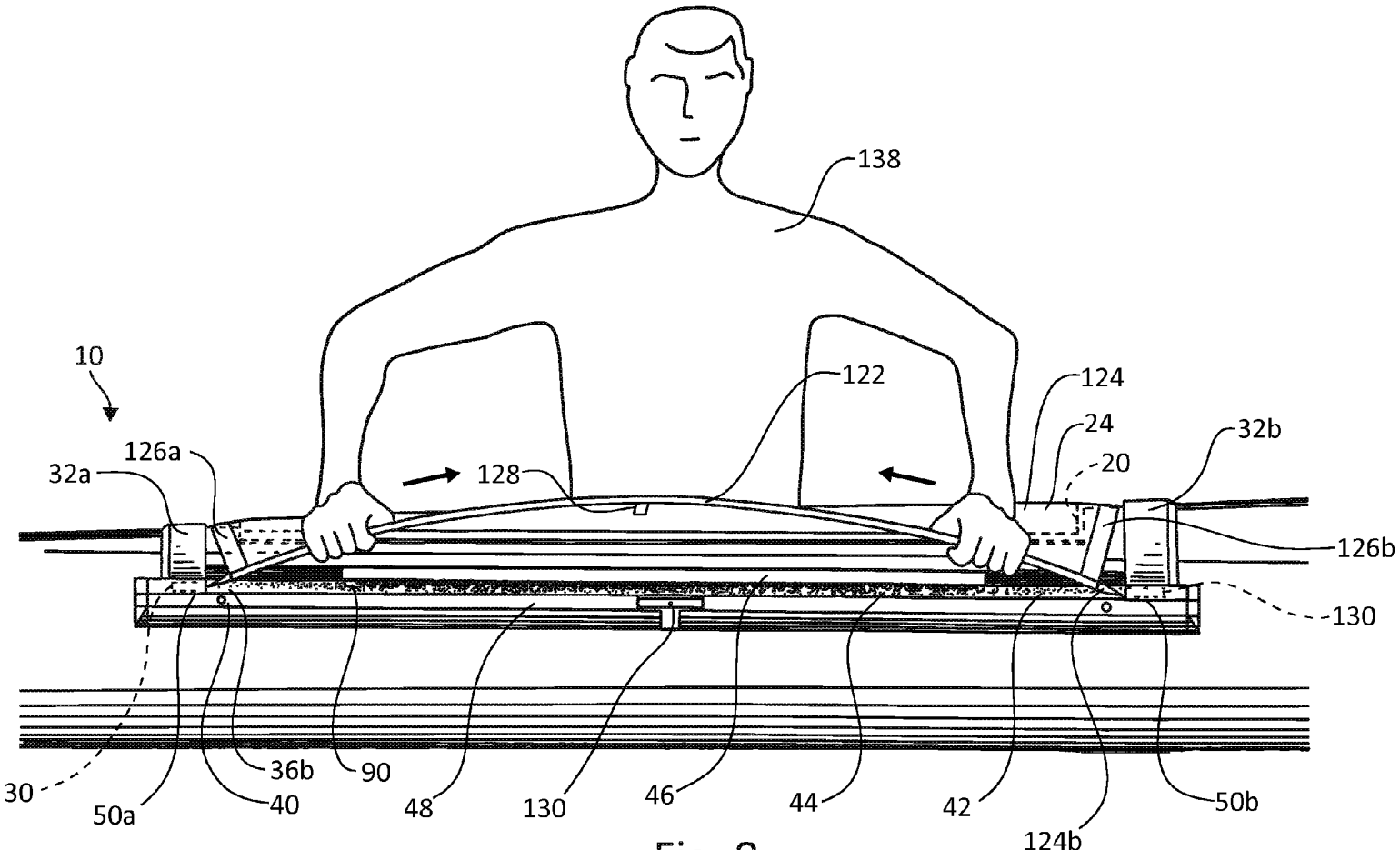
FIG. 8 is schematic illustration of a user applying the hatch cover over the hatch of the kayak of FIG. 1, according to one embodiment of the present invention.

One embodiment of hatch cover 24 is illustrated with reference to FIGS. 1, 3, 7, and 8. Hatch cover 24 includes a primary member or flexible fabric portion 120 defining longitudinal sleeves 122 extending along opposite sides or margins thereof (e.g., along a starboard margin and a port margin of hatch cover 24) between a fore end 123*a* and an aft end 123*b* of flexible fabric portion 120. Flexible fabric portion 120 is lightweight, water-resistant (e.g., water proof), and sized larger than and configured to tightly stretch over hatch 20 (indicated in dashed lies in FIG. 7 for illustrative purposes). In one embodiment, flexible fabric portion 120 also stretches over at least a portion of upper channel members 46 of each of starboard rod receptacle 36*a* and port rod receptacle 36*b*. In one example, flexible fabric portion 120 is formed from a water-resistant (e.g., waterproof) and partially elastic material or other suitable material. Flexible fabric portion 120 can take any suitable shape to fully cover hatch 20 and at least a portion of the surround deck 14. In one example, as illustrated in FIG. 7, flexible fabric portion 120 is generally in the shape of a trapezoid with a narrower fore end 123*a* as compared to aft end 123*b* to correspond with a narrowing of deck 14 as deck extends toward the bow of kayak 10.

In one embodiment, longitudinal sleeves 122 are each defined to correspond with opposite ones of a starboard and port side of flexible fabric portion 120 substantially extending along an entire length of flexible fabric portion 120. In one example, hatch cover 24 includes a starboard rod 124*a* and a port rod 124*b* each positioned to longitudinally extend through one of longitudinal sleeves 122. In one example, each rod 124*a* and 124*b* extends through and beyond each lateral end (e.g., fore and aft ends 123*a* and 123*b*) of a respective longitudinal sleeve 122 such that each rod 124*a* and 124*b* has a first end 125*a* and a second opposite end 125*b* exposed. In one example, each end 125*a* and 125*b* is tapered into a frustoconical or cone-like shape as it extends away from the opposite one of ends 125*a* and 125*b*. At least each end 125*a* and 125*b*, if not rods 124*a* and 124*b* in their entireties, has a smaller outer diameter as compared to the inside diameter of a corresponding rod reception pocket 50*a* or 50*b* of frame 26. In addition, the resulting thickness of one of rods 124*a* and 124*b* in one of longitudinal sleeves 122 is slightly less than a height of elongated channel between upper channel member 46 and lower channel member 48. In one embodiment, each of rods 124*a* and 124*b* have a diameter or outer dimension of about ⅜ inch to about ⅝ inch (e.g., ¼ inch) to provide sufficient rigidity while still having flexibility to function as described therein. Other diameters are also contemplated as will be apparent to those of skill in the art upon reading the present application.

Rods 124*a* and 124*b* may be formed of any suitable material that is relatively rigid, but having somewhat elastic properties to allow flexing of the respective rod 124*a* and 124*b* under compressive force and to return to an original, non-flexed length with the compressive force is removed. For example, rods 124*a* and 124*b* may be formed from fiberglass, carbon fiber, metal, wood, or other suitable material. In one embodiment, rods 124*a* and 124*b* are permanently secured to flexible fabric portion 120 via sewing or other suitable means to ensure that rods 124*a* and 124*b* hold flexible fabric portion 120 taut when stretch between opposing elongated channels 44.

In one example, a fore elastic band 126*a* and an aft elastic band 126*b* are coupled with flexible fabric portion 120 (e.g., via sewing, adhesive, sleeves, or other suitable attachment) at a corresponding one of each of fore end 125*a* and aft end 125*b*. For instance, each elastic band 126*a* and 126*b* extends between opposing longitudinal sleeves 122. In one embodiment, elastic band 126*a* and elastic band 126*b* are each of a similar lateral length as corresponding fore and aft ends 123*a* and 123*b* except for longitudinal sleeves 122, and in one embodiment, each elastic band 126*a* and 126*b* is initially slightly shorter than, but configured to be stretched to, a lateral length of the corresponding one of fore and aft ends 123*a* and 123*b*. Other features may be added to hatch cover 24, such as, a pull tab 128 laterally and outwardly extending from flexible fabric portion 120, e.g., from a corresponding one of longitudinal sleeves 122 to allow a user to more easily manipulate hatch cover 24 to remove it from elongated channel 44 as will be further described below. Notably, although described above as having longitudinal sleeves 122 and rods 124 on the starboard and port sides of flexible fabric portion 120 and elastic bands 126*a* and 126*b* on the fore and aft ends 125*a* and 125*b* of flexible fabric portion 120, those of skill in the art will recognize upon reading this application that, in other embodiments, longitudinal sleeves 122 and rods 124 are on the fore and aft ends 125*a* and 125*b* while elastic bands 126*a* and 126*b* are on the starboard and port sides of flexible fabric portion 120.

During use of kayak 10, cargo hold 16 is loaded with gear, provisions, and other items through hatch 20. When conditions will be inclement (e.g., rain, wind, etc.) or it is otherwise desired to cover hatch 20, hatch cover 24 can easily be placed over hatch 20 covering items therein and protecting such items from the environment. More specifically, in one embodiment, port rod 124*b* is flexed slightly by applying axial, compressive force or pressure generally in the direction indicated by the arrows in FIG. 8. The flexure of port rod 124*b* temporarily shortens an overall length of port rod 124*b* allowing port rod 124*b* to be placed within elongated channel 44 such that fore end 123*a* and aft end 123*b* can respectively be aligned with opposing cavities 102 of rod reception pockets 50*a* and 50*b* on either end of elongated channel 44.

Figure 9:
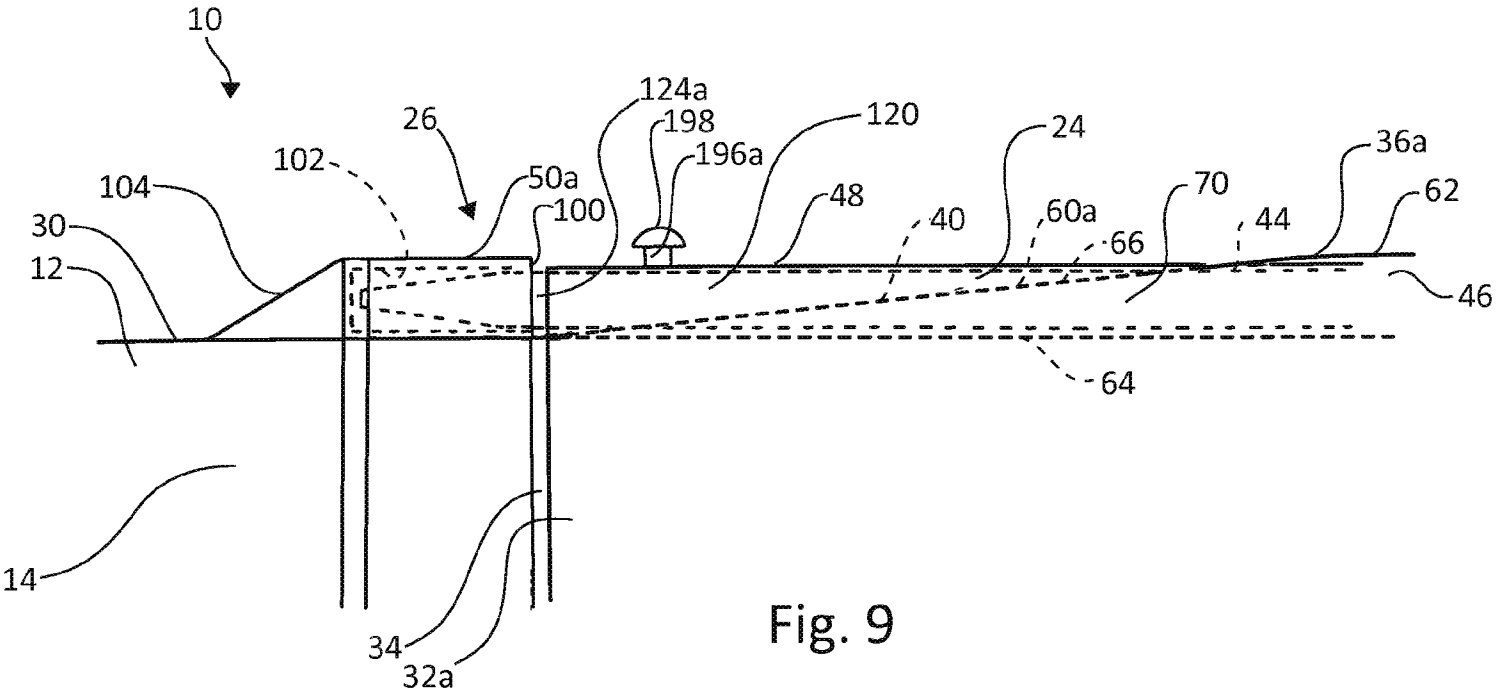
FIG. 9 is an enlarged top, view illustration of the hatch cover assembled with a hull of the kayak of FIG. 1, according to one embodiment of the present invention.

Once aligned, the compressive force on port rod 124*b* is removed causing port rod 124*b* to return to its original length pushing fore end 123*a* and aft end 123*b* into the corresponding ones of cavities 102 (see also, FIG. 9). Since elongated channel 44 is defined between internal end surfaces 100 of rod reception pockets 50*a* and 50*b* is shorter than an overall length of port rod 124*b* when extended, port rod 124*b* is secured within elongate channel 44 between internal end surfaces 100. When port rod 124*b* is positioned in elongated channel 44, in one embodiment, port rod 124*b*, or more particularly, portion of flexible fabric portion 120 forming longitudinal sleeve 122 around port rod 124*b*, is pushed into interaction with rod channel gasket 90 forming a water resistant and secure seal. Rod channel gasket 90 also provides cushion to port rod 124*b* positioned in elongated channel 44 to prevent clicking or other sounds during use if port rod 124*b* were allowed to intermittently contact hull sidewall 30 within elongated channel 44.

Figure 3:
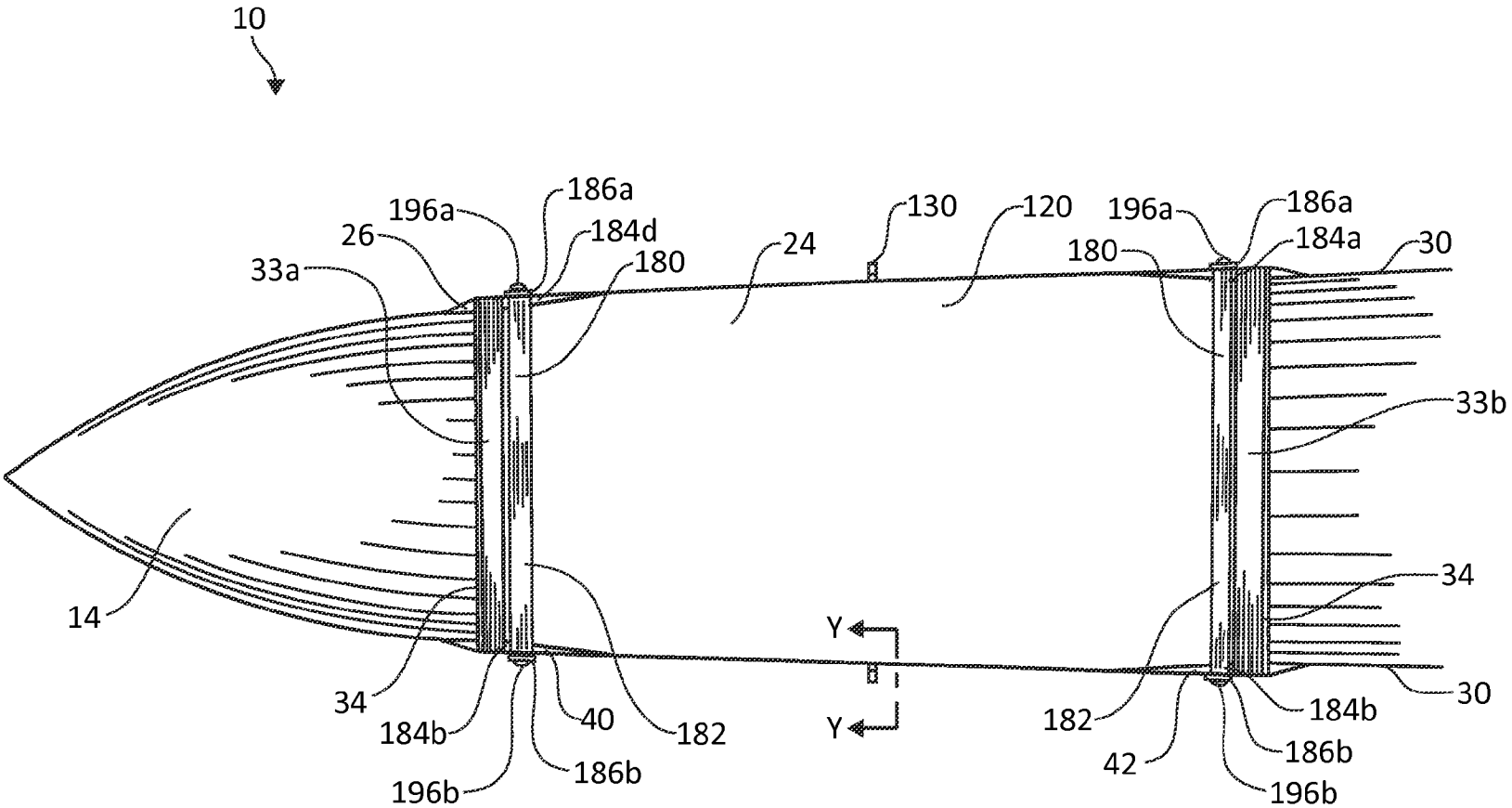
FIG. 3 is a top view illustration of the hatch cover of FIG. 1 applied over the hatch of FIG. 2, according to one embodiment of the present invention.
Figure 4:
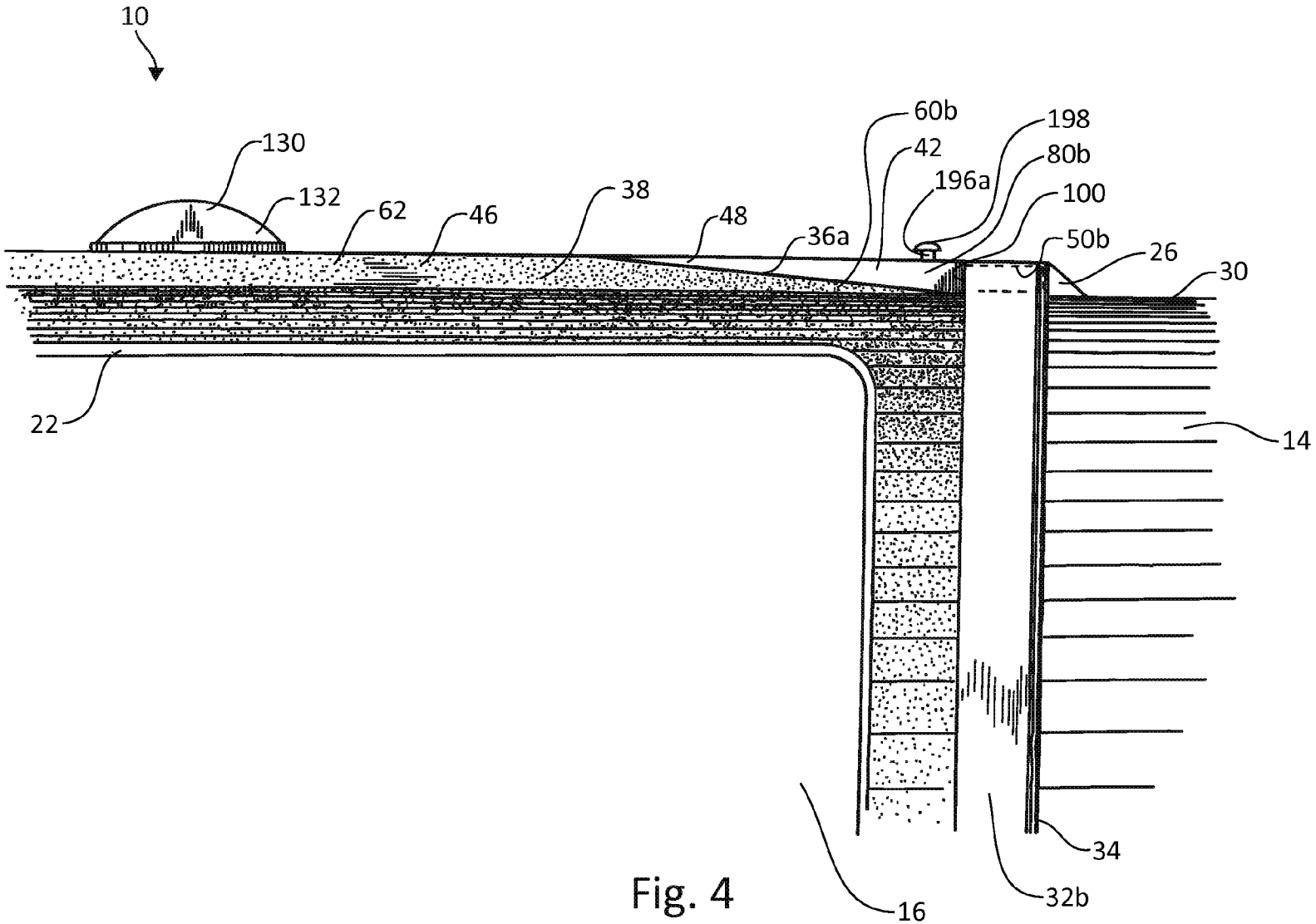
FIG. 4 is an enlarged portion of a top view illustration of the kayak of FIG. 2, according to one embodiment of the present invention.
Figure 10:
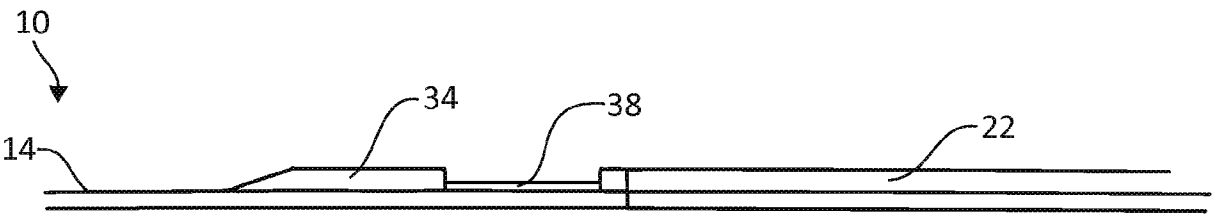
FIG. 10 is an enlarged, bottom view illustration of the hatch cover assembled with a hull of the kayak of FIG. 1, according to one embodiment of the present invention.

When port rod 124*b* is secured, starboard rod 124*a* is similarly secured within the opposing elongated channel 44. To so position starboard rod 124*a*, flexible fabric portion 120 is stretched tightly over hatch 20 such that a lower surface (not shown) of flexible fabric portion 120 contacts and is held taut over upper channel members 46 and raised inner gasket 22 around hatch 20 to form a water-resistant seal, and tightly extends over each upper channel member 46 as generally indicated shown in FIG. 6. When flexible fabric portion 120 is so stretched, in one embodiment, elastic bands 126*a* and 126*b* are each also stretched to push ends 125*a* and 125*b* of flexible fabric portion 120 tightly into outer gasket 38 extending just inside (i.e., on a hatch sides of) the respective deck hydraulic barriers 32 to form a water-resistant seal as illustrated in FIGS. 3 and 10. As such, the series of gaskets, that is outer gasket 38 and raised inner gasket 22, rod channel gasket 90, and the pressure of stretched and secured flexible fabric portion 120 over the series of gaskets forms a numerous water-resistant barriers preventing or at least greatly decreasing water penetrating hatch cover 24 and approaching hatch 20, which provides hydraulic security to hatch 20 and the items stored in cargo hold 16 below.

In one embodiment, no additional securing means are included in hatch opening frame 26 or hatch cover 24. In one example, hatch cover 24 is easily removed from hatch frame 26 by pulling outwardly (i.e., away from hull 12) on pull tabs 128 causing the corresponding rods 124*a* and 124*b* to flex outwardly from hull 12, which either pulls ends 125*a* and 125*b* from the respective cavity 102 and/or allows a user to grasp rod 124*a* or 124*b* causing additional flexure to remove ends 125*a* and 125*b* from their respective cavities 102 thereby removing rod 124*a* or 124*b* from the corresponding elongated channel 44. The tapering of fore and aft end sections 60*a* and 60*b* of upper channel member 46 also facilitate a user in engaging rod end 125*a* into receptive cavity 102 and placement of rod 124*a* or 124*b* into elongated cavity 44. Since hatch cover 24 is primarily made of flexible fabric portion 120, hatch cover 24 can easily be rolled and/or folded up around rods 124*a* and 124*b* in the lateral direction for storage and/or other periods of non-use.

The generally flexible hatch cover 24 provides a user with additional storage space by allowing flexure of hatch cover 24 to accommodate items (e.g., large or irregularly shaped items) that may otherwise protrude above a top edge of hatch 20 and/or raised inner gasket 22. Flexible hatch cover 24 is generally lightweight as compared to its rigid counterparts and can be relatively quickly secured to or removed from kayak 10. The light weight of hatch cover 24 facilitates easy attachment and removal from kayak 10 to expose hatch 20 and contributes to an overall lighter weight of kayak 10, which is of added importance if kayak 10 is portaged or otherwise carried for any distance, and can increase the speed of kayak 10 through the water. In one embodiment, hatch 20 is accessible when hatch cover 24 is completely removed from kayak 10 or when hatch cover 24 is only partially removed from kayak 10. In particular, a user may remove one of rods 124*a* and 124*b* from its respective elongated channel 44 and fold back a portion of flexible fabric portion 120 to expose hatch 20 without need to remove the other one of rods 124*a* and 124*b* from its respective elongated channel 44. By only partially removing hatch cover 24, speed of reattachment is increased and hatch cover 24 is not as easily misplaced since it remains partially coupled with kayak 10.

Additional or alternative means for coupling hatch cover 24 to cover hatch 20 are also contemplated. For example, in one embodiment as illustrated with reference to FIGS. 1-4, 11, and 12, a latch 130 is formed and is configured to effectively lock one of rods 124*a* and 124*b* within elongated channel 44. In one example, latch 130 includes a movable latch plate 132 and a knob 134. Latch plate 132 defines an interior substantially planar surface 146 facing toward kayak 10 and having at least one dimension greater than a distance between upper channel member 46 and lower channel member 48 (e.g., greater than a height of elongated channel 44) and an opposite exterior surface 148. In one example, latch plate 132 defines handling portions 140 and a void 142. Handling portions 140 extend from exterior surface 148, which is substantially planar, to provide protruding areas of latch plate 132 relatively easily grasped by a user. Void 142 is formed where exterior surface 148 is defined between handling portions 140. In one example, a hole or aperture 144 is defined through and centered on latch plate 132 aligned with void 142. In one embodiment, movable latch plate 132 defines a beveled edge 150 tapered inwardly as exterior surface 148 extends from an outer edge of moveable latch plate 132.

In one embodiment, a threaded cylinder 152 is threadably coupled with knob 134, which is substantially circular and coaxially positioned with respect to threaded cylinder 152. Knob 134 is rotatable to change a position of knob 134 relative to a longitudinal length of threaded cylinder 152. Threaded cylinder 152 extends from knob 134 through aperture 144 in latch plate 132, and knob 134 is positioned between handling portions 140 of latch plate 132. Threaded cylinder 152 extends through a hole in lower channel member 48 and/or perhaps through hull sidewall 30 and is capped with a nut 154 opposite knob 134. In one example, nut 154 is bonded to threaded cylinder 142 and/or an interior of hull sidewall 30 such that when knob 134 is rotated, threaded cylinder 142 generally remains stationary and does not rotate.

Figure 11:
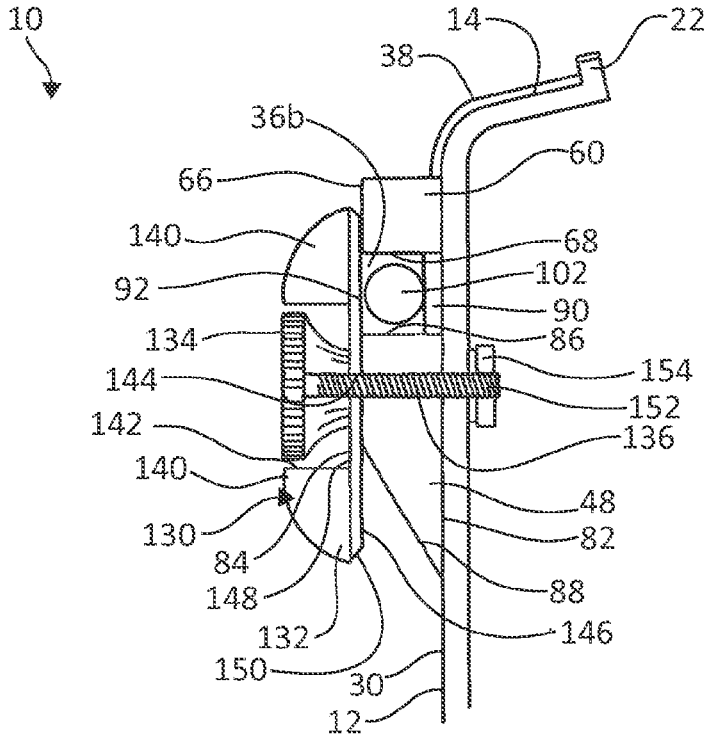
FIG. 11 is an enlarged rear, cross-sectional view illustration of a clamp mechanism for the kayak of FIG. 1, according to one embodiment of the present invention.
Figure 12:
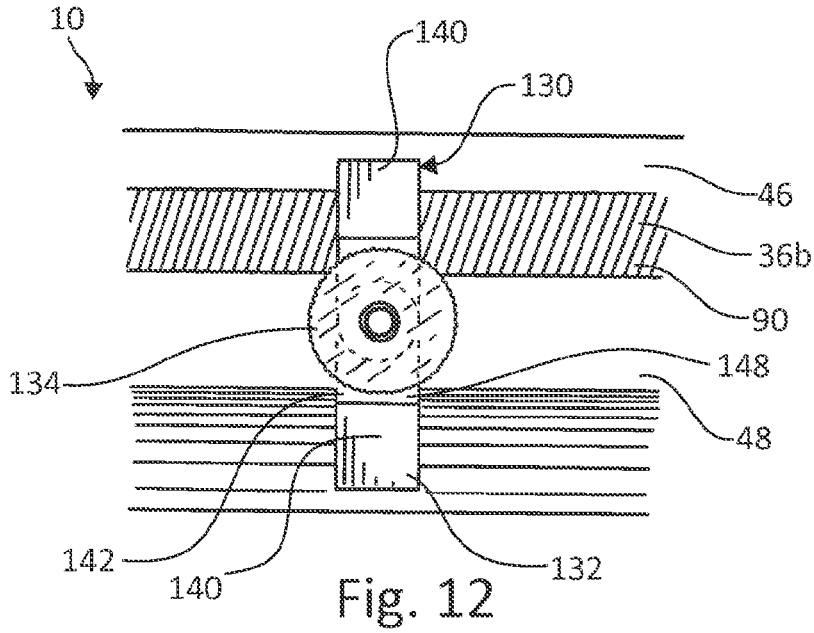
FIG. 12 is an enlarged side view illustration of a clamp mechanism for the kayak of FIG. 1, according to one embodiment of the present invention.
Figure 13:
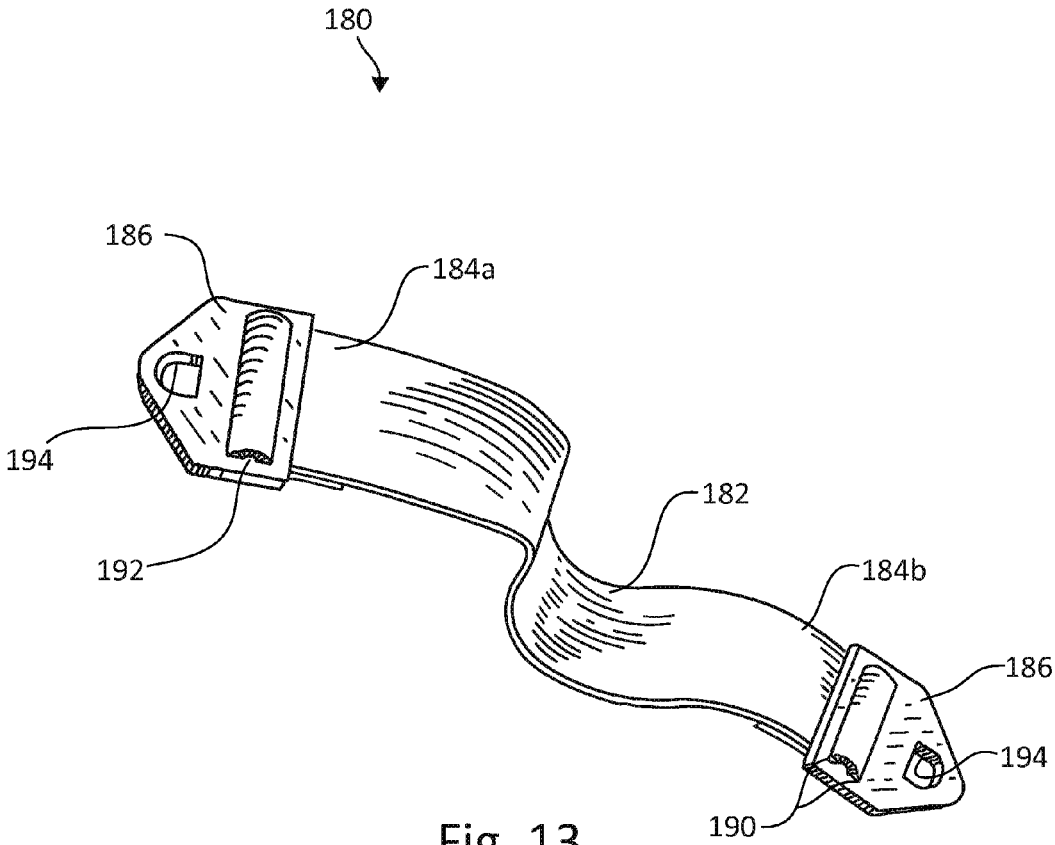
FIG. 13 is a perspective view illustration of a strap for securing the hatch cover of FIG. 1, according to one embodiment of the present invention.

When properly positioned, as illustrated in FIGS. 11 and 12, for example, latch plate 132 extends vertically across outer open slot 92 of elongated channel 44. When rod 124*a* or 125*b* is placed in elongated channel 44, latch plate 132 is secured in the vertical orientation to contribute to holding rod 124*a* or 125*b* in place by tightening knob 134 on threaded cylinder 152 toward hull sidewall 30 such that latch plate 132 is tightly held against front surfaces 66 and 84 of upper channel member 46 and lower channel member 48, respectively. In one example, beveled edge 150 of latch plate 132 allows latch plate 132 to smoothly compress flexible fabric portion 120 around rods 124*a* or 124*b* as it is rotated into the closed or vertical position.

When it is desired that rod 124*a* or 124*b* be released from a respective elongated channel 44, knob 134 is rotated to move outwardly along threaded cylinder 152 away from hull sidewall 30, which loosens and allows rotation of latch plate 132 relative to elongated channel 44. Latch plate 132 is rotated to a substantially horizontal position such that latch plate 132 extends substantially below top surface 86 of lower channel member 48 and generally does not extend across outer open slot 92 of elongated channel 44 and, therefore, does not block removal of rod 124*a* or 124*b* therefrom when desired. In the attached figures, one latch 130 is illustrated near a mid-portion of each elongated channel 44. Those of skill in the art will realize upon reading this application that any number of latches 130 may be longitudinally spaced along elongated channel 44 depending upon the desired level of securement for rods 124*a* and/or 124*b* relative to kayak 10. In one embodiment, latches 130 are provided for selective use only when weather conditions or other conditions suggest that additional securement of rods 124*a* and 124*b* may be necessary.

In one example, as illustrated with reference to FIGS. 3, 4, 9, and 13, storm straps 180 are additionally or alternatively provided to increase security and water tightness for each hatch 20 during rough seas or otherwise harsh weather conditions. In one embodiment, each storm strap 180 includes an elongated elastic member 182 with a first end 184*a* and an opposite, second end 184*b*. Each end 184*a* and 184*b* is coupled to an end clip 186. In one example, each end clip 186 is substantially planar and defines a pair of slots 190, a bar 192 between pair of slots 190, and an aperture 194 spaced outwardly from pair of slots 190. Elastic member 182 is coupled to each end clip 186 by threading an end 184*a* or 184*b* through one of pair of slots 190, over bar 192, and through the other one of pair of slots 190 and, in one embodiment, is then folded over and secured to itself.

During use storm strap 180 is secured to kayak 10 by fastening one end clip 186 over a stud head 196*a* (see FIG. 2) extending outwardly from one side of hull 12 via aperture 194 of the one end clip 186, stretching elastic member 182 across flexible fabric portion 120, and fastening the opposite end clip 186 over a stud head 196*b* (see FIG. 2) via the corresponding aperture 194 in the opposite end clip 186. In one embodiment, a storm strap 180 is secured across both fore end 125*a* and aft end 125*b* of hatch cover 24 between one of deck hydraulic barrier 32 and raised inner gasket 22. By stretching elastic member 182 across hatch cover 24, additional pressure is applied to hatch cover 24 pressing hatch cover 24 into outer gasket 38 with even more force than elastic bands 126*a* and 126*b*. Elastic member 182 is generally wider and stronger than either elastic band 126*a* and 126*b*, which are permanently attached to flexible fabric portion 120 of hatch cover 24.

Figure 5:
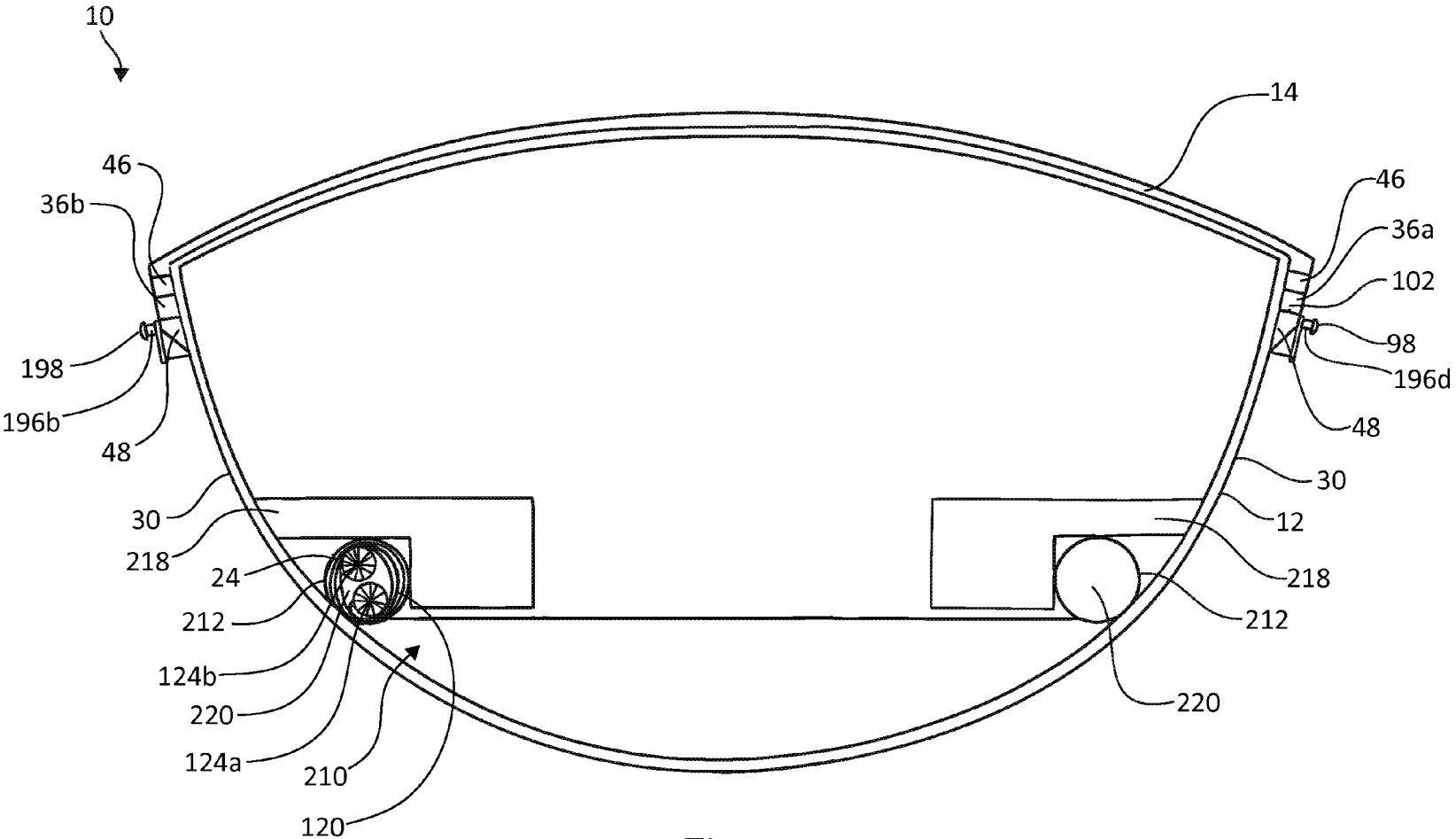
FIG. 5 is a cross-sectional illustration the kayak taken about the line X-X through a cockpit of the kayak as indicated in FIG. 14, according to one embodiment of the present invention.
Figure 14:
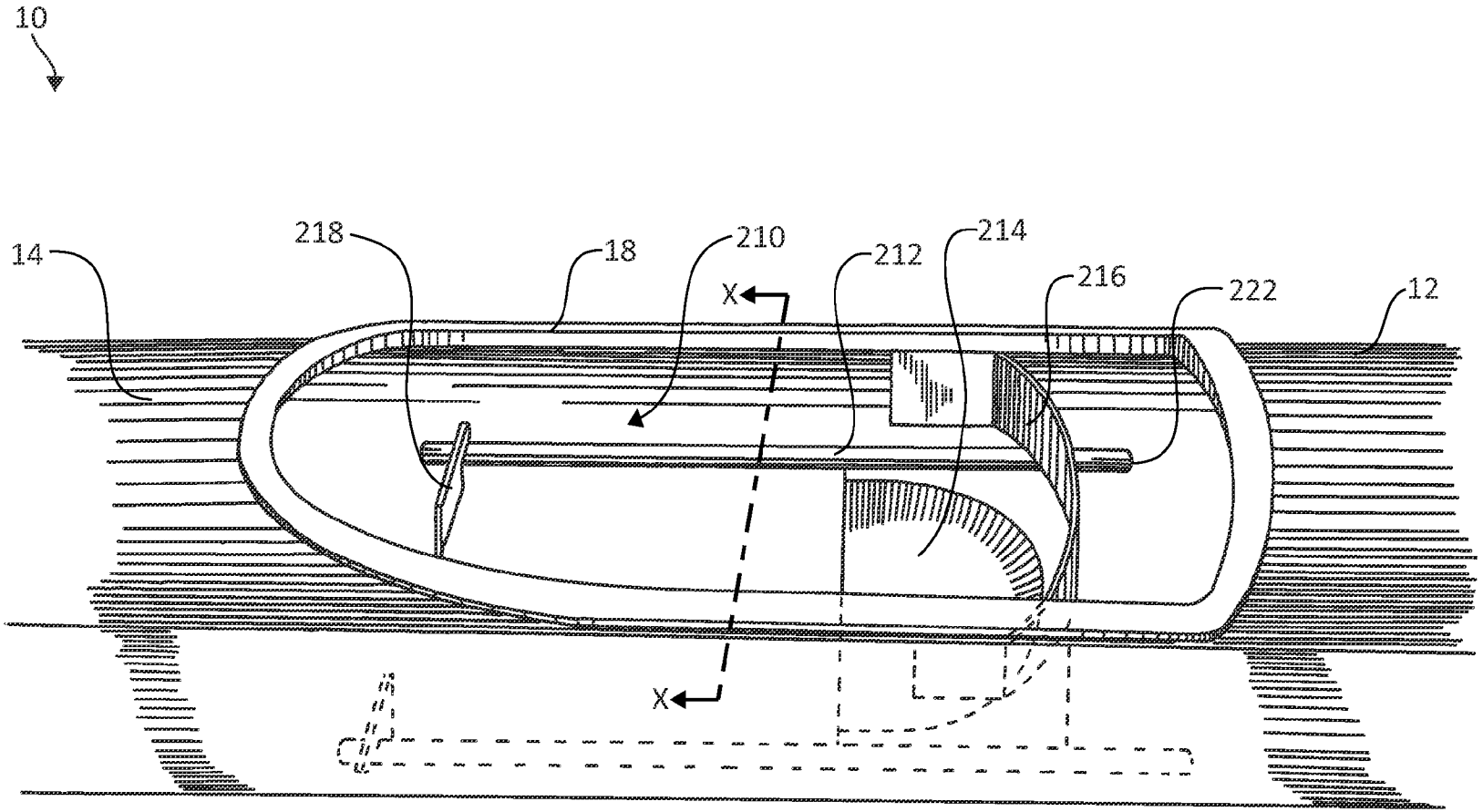
FIG. 14 is a side, perspective view illustration of a cockpit of the kayak of FIG. 1, according to one embodiment of the present invention.

Referring to FIGS. 5 and 14, in one embodiment, a storage system 210 is formed within hull 12 for selectively storing hatch covers 24 when hatch covers 24 are rolled or folded into elongated rolls about rods 124*a* and 124*b*. In one example, storage system 210 includes a relatively rigid storage tube 212, e.g., formed of plastic, of sufficient inside diameter to form a cavity 220 able to accommodate at least one of the rolled or folded hatch covers 24. In one embodiment, two storage tubes 212 are provided—one for each hatch cover 24 where an aft and a fore hatch 20 are formed in deck 14 and two corresponding hatch covers 24 are provided. In one example, each storage tube 212 is coupled with an interior of hull sidewall 30 on opposing starboard and port sides thereof. In the illustrated embodiment, each storage tube 212 is positioned along the upper starboard and port edges of seat 214 in a position that will generally not interfere with normal operation of kayak 10. Each storage tube 212 has at least one open end 222 through which rolled or folded hatch cover 24 can be inserted and removed as will be apparent to those of skill in the art upon reading this application.

In one example, seat 214 can be slid longitudinally with respect to storage tubes 212 to adjust positioning of seat 214. In one embodiment, a foot brace 218 is defined to extend from interior surfaces of opposite hull sidewalls 30 and around and substantially perpendicular to the longitudinal extension of storage tubes 212 as shown in FIG. 5 to provide a brace for receiving feet of the kayak operator providing the kayak operator with additional leverage when paddling, etc. In one example, seat 214 is provided with a backrest 216, which may be similar to the backrest described in U.S. Pat. No. 7,562,635, entitled "Kayak Portaging Device," which is hereby incorporated by reference, to further ease portaging of kayak 10 and all components thereof.

Although the invention has been described with respect to particular embodiments, such embodiments are meant for illustrative purposes only and should not be considered to limit the invention. Various alternatives and changes will be apparent to those of ordinary skill in the art. Other modifications within the scope of the invention and its various embodiments will be apparent to those of ordinary skill.

What is claimed is:

1. A personal watercraft system comprising:

a personal watercraft including a deck and a hull, the personal watercraft defining a hatch through the deck, the hatch providing access to a cargo hold inside the personal watercraft;

a frame coupled with the personal watercraft and defining:

an elongated channel on a first side of the hatch, the elongated channel having a first channel end and a second channel end opposite the first channel end, a first cavity extending away from the first channel end of, substantially axially aligned with, and in communication with the elongated channel, the first cavity having a first cavity opening facing the elongated channel, and a second cavity extending away from a second channel end of, substantially axially aligned with, and in communication with the elongated channel, the second cavity having a second cavity opening facing the elongated channel;

a cover including a flexible fabric portion and a rod extending along and coupled with a side margin of the flexible fabric portion, the rod having a first rod end and a second rod end opposite the first rod end;

wherein:

the cover is configured to be secured to the personal watercraft on a second side of the hatch opposite the first side of the hatch, when a compressive force is applied to the rod, the rod flexes to align the first rod end with the first cavity and the second rod end with the second cavity, and when the compressive force is subsequently removed from the rod, the rod returns to its original length and the first rod end slides into the first cavity, the second rod end slides into the second cavity, and a portion of the rod between the first rod end and the second rod end is selectively maintained within the elongated channel in a manner securing the cover to the personal watercraft to entirely cover the hatch.

2. The personal watercraft system of claim 1, wherein the elongated channel and the cavity are positioned to extend from the hull of the personal watercraft.

3. A personal watercraft system comprising:

a personal watercraft including a deck and a hull, the personal watercraft defining a hatch through the deck, the hatch providing access to a cargo hold inside the personal watercraft;

a frame coupled with the personal watercraft and defining:

a first elongated channel on a first side of the hatch, a first cavity extending away from, substantially axially aligned with, and in communication with the elongated channel, a second elongated channel on the second side of the hatch positioned to extend from the hull of the personal watercraft, and a second cavity extending away from, substantially axially aligned with, and in communication with the second elongated channel;

a cover including a flexible fabric portion, a first rod extending along and coupled with a side margin of the flexible fabric portion, and a second rod extending along and coupled with an opposite side margin of the flexible fabric portion, wherein:

the second rod is configured to be secured within the second elongated channel such that an end of the second rod is received within the second cavity;

the cover is configured to be secured to the personal watercraft on a second side of the hatch opposite the first side of the hatch, when a compressive force is applied to the rod, the rod flexes to fit within the elongated channel such that an end of the rod is aligned with the cavity, when the compressive force is subsequently removed from the rod, the rod returns to its original length and the end of the rod slides into the cavity in a manner securing the cover to the personal watercraft to entirely cover the hatch.

4. The personal watercraft system of claim 1, wherein the elongated channel extends outwardly from an external surface of the hull.

5. A personal watercraft system comprising:

a personal watercraft including a deck and a hull, the personal watercraft defining a hatch through the deck, the hatch providing access to a cargo hold inside the personal watercraft;

a frame coupled with the personal watercraft and defining:

an elongated channel on a first side of the hatch, and a cavity extending away from, substantially axially aligned with, and in communication with the elongated channel;

a cover including a flexible fabric portion and a rod extending along and coupled with a side margin of the flexible fabric portion;

wherein:

the cover is configured to be secured to the personal watercraft on a second side of the hatch opposite the first side of the hatch, when a compressive force is applied to the rod, the rod flexes to fit within the elongated channel such that an end of the rod is aligned with the cavity, when the compressive force is subsequently removed from the rod, the rod returns to its original length and the end of the rod slides into the cavity in a manner securing the cover to the personal watercraft to entirely cover the hatch, the frame includes:

a first deck hydraulic barrier on a bow side of the hatch extending upwardly from the deck, and a second deck hydraulic barrier on a stern side of the hatch extending upwardly from the deck, and the flexible fabric portion extends over the deck and the hatch between the first deck hydraulic barrier and the second deck hydraulic barrier.

6. The personal watercraft system of claim 5, wherein each of the first deck hydraulic barrier and the second deck hydraulic barrier are tapered as they extend away from one another.

7. The personal watercraft system of claim 5, wherein:

an outer gasket material covers the deck between the first deck hydraulic barrier and the second deck hydraulic barrier;

the cover includes:

a first elastic band extending across a fore end of the flexible fabric portion, and a second elastic band extending across an aft end of the flexible fabric portion; and when cover is secured to the personal watercraft on the first side and the second side of the hatch, the first elastic band and the second elastic band each press the cover into the outer gasket material to each form a water resistant seal.

8. The personal watercraft system of claim 7, wherein the first deck hydraulic barrier and the second deck hydraulic barrier each extend upwardly from the deck further than the outer gasket material extends upwardly from the deck, such that the first deck hydraulic barrier and the second deck hydraulic barrier each at least partially shield the water resistant seal formed by each of the first elastic band and the second elastic band.

9. The personal watercraft system of claim 7, further comprising an inner raised gasket circumferentially extending around the hatch, the inner raised gasket extending upwardly from the deck further than the outer gasket material extends upwardly from the deck, and the cover is taut over and presses into the inner raised gasket when the cover is secured to the personal watercraft on the first side and the second side of the hatch.

10. The personal watercraft system of claim 7, wherein:

the personal watercraft includes:

a first stud head extending outwardly from the frame on a starboard side of the hull, and a second stud head extending outwardly from the frame on a port side of the hull, the personal watercraft system further comprises an elongated, elastic storm strap formed separately from the cover and including a clip on each opposing end of the elongated, elastic storm strap, and each clip receives one of the first stud head and the second stud head such that the elongated, elastic storm strap is secured to the deck and stretched between the first stud head and the second stud head to further press the flexible fabric portion into the outer gasket material.

11. A personal watercraft system comprising:

a personal watercraft including a deck and a hull, the personal watercraft defining a hatch through the deck, the hatch providing access to a cargo hold inside the personal watercraft;

a frame coupled with the personal watercraft and defining:

an elongated channel on a first side of the hatch, and a cavity extending away from, substantially axially aligned with, and in communication with the elongated channel;

a cover including a flexible fabric portion and a rod extending along and coupled with a side margin of the flexible fabric portion, wherein the cover is configured to be secured to the personal watercraft on a second side of the hatch opposite the first side of the hatch; and an inner raised gasket circumferentially extending around the hatch, wherein the cover is taut over and presses into the inner raised gasket when the cover is secured to the personal watercraft on the first side and the second side of the hatch;

wherein:

when a compressive force is applied to the rod, the rod flexes to fit within the elongated channel such that an end of the rod is aligned with the cavity, and when the compressive force is subsequently removed from the rod, the rod returns to its original length and the end of the rod slides into the cavity in a manner securing the cover to the personal watercraft to entirely cover the hatch.

12. A personal watercraft system comprising:

a personal watercraft including a deck and a hull, the personal watercraft defining a hatch through the deck, the hatch providing access to a cargo hold inside the personal watercraft;

a frame coupled with the personal watercraft and defining:

an elongated channel on a first side of the hatch, and a cavity extending away from, substantially axially aligned with, and in communication with the elongated channel;

a cover including a flexible fabric portion and a rod extending along and coupled with a side margin of the flexible fabric portion;

wherein:

the cover is configured to be secured to the personal watercraft on a second side of the hatch opposite the first side of the hatch, when a compressive force is applied to the rod, the rod flexes to fit within the elongated channel such that an end of the rod is aligned with the cavity, when the compressive force is subsequently removed from the rod, the rod returns to its original length and the end of the rod slides into the cavity in a manner securing the cover to the personal watercraft to entirely cover the hatch, an open slot provides access to the elongated channel, and the personal watercraft system further comprises a latch selectively covering a portion of the open slot to further secure the rod within the open slot.

13. The personal watercraft system of claim 1, wherein the hatch has a dimension greater than one foot.

14. A personal watercraft system comprising:

a personal watercraft including a deck and a hull, the personal watercraft defining hatch through the deck, the hatch providing access to a cargo hold inside the personal watercraft;

a frame coupled with the personal watercraft and defining:

an elongated channel on a first side of the hatch, and a cavity extending away from, substantially axially aligned with, and in communication with the elongated channel;

a cover including a flexible fabric portion and a rod extending along and coupled with a side margin of the flexible fabric portion;

wherein:

the cover is configured to be secured to the personal watercraft on a second side of the hatch opposite the first side of the hatch, when a compressive force is applied to the rod, the rod flexes to fit within the elongated channel such that an end of the rod is aligned with the cavity, when the compressive force is subsequently removed from the rod, the rod returns to its original length and the end of the rod slides into the cavity in a manner securing the cover to the personal watercraft to entirely cover the hatch, the frame includes an upper channel member and a lower channel member on the first side of the hatch extending from the hull, the elongated channel is defined between the upper channel member and the lower channel member, and a rod channel gasket extends over the hull within the elongated channel.

15. The personal watercraft system of claim 14, wherein the upper channel member is tapered toward the hull at opposing ends thereof.

16. The personal watercraft system of claim 1, wherein the personal watercraft is a kayak including a cockpit, and the hatch is positioned on one of a bow side and a stern side of the cockpit.

17. A method of securing a cover over a hatch of a personal watercraft system, the method comprising:

providing the personal watercraft including a deck and a hull, the personal watercraft defining the hatch through the deck, the hatch providing access to a cargo hold inside the personal watercraft, wherein the personal watercraft further includes:

a frame including:

an elongated channel on a first side the personal watercraft, and a cavity extending away from, substantially axially aligned with, and in communication with the elongated channel, securing a cover to the personal watercraft to extend over the hatch in a manner providing hydraulic security to the hatch, wherein the cover includes:

a flexible fabric portion sized larger than the hatch, and a rod extending along and coupled with a side margin of the flexible fabric portion;

wherein securing the cover to the personal watercraft includes:

stretching the cover, which has previously been coupled to a second side of the personal watercraft opposite the first side of the personal watercraft, to extend over the hatch to the first side of the personal watercraft, and applying a compressive force to the rod causing the rod to flex to fit within the elongated channel such that an end of the rod is aligned with the cavity, and when the compressive force is subsequently removed from the rod, the rod returns to its original length and the end of the rod interfaces with the cavity in a manner securing the cover to the personal watercraft to entirely cover the hatch.

18. The method of claim 17, wherein:

the providing the personal watercraft includes:

providing the frame to include:

a first deck hydraulic barrier on a bow side of the hatch extending upwardly from the deck, and a second deck hydraulic barrier on a stern side of the hatch extending upwardly from the deck, and providing an outer gasket material covering the deck between the first deck hydraulic barrier and the second deck hydraulic barrier, and the securing the cover to the personal watercraft includes positioning a first elastic band, which extends across a fore end of the flexible fabric portion of the cover, on a hatch side of the first deck hydraulic barrier and positioning the second elastic band, which extends across an aft end of the flexible fabric portion of the cover, on a hatch side of the second deck hydraulic barrier such that the first elastic band and the second elastic bank each press the cover into the outer gasket material to form a hydraulic seal between the cover and the outer gasket material.

19. The method of claim 18, wherein the securing the cover to the personal watercraft includes pressing the cover into contact with an inner gasket extending around and immediately adjacent the hatch to form another hydraulic seal, and the inner gasket extends above the outer gasket material relative to the deck.

* * * * *